US006094756A

United States Patent [19]

Carter

[11] Patent Number: 6,094,756

[45] Date of Patent: Aug. 1, 2000

[54] SHOWER CHAIR

[76] Inventor: Carolyn Carter, 44 London Rd., Burlington, N.J. 08016

[21] Appl. No.: 09/296,314

[22] Filed: Apr. 22, 1999

[51] Int. Cl.[7] ..... A47K 3/022

[52] U.S. Cl. ..... 4/578.1; 4/567; 4/574.1; 4/575.1; 4/611

[58] Field of Search ..... 4/571.1, 574.1, 4/575.1, 578.1, 579, 567, 568, 570, 611

[56] References Cited

U.S. PATENT DOCUMENTS

| | | | |
|---|---|---|---|
| 1,512,581 | 10/1924 | Deming | 4/570 X |
| 3,169,253 | 2/1965 | Segar | 4/611 |
| 3,290,090 | 12/1966 | Ford | 4/578.1 X |
| 3,855,646 | 12/1974 | Glickman | 4/578.4 |
| 4,166,297 | 9/1979 | Saleeby | 4/578.1 |

*Primary Examiner*—Robert M. Fetsuga

[57] ABSTRACT

A shower chair for permitting a user to take a shower without their legs becoming wet. The shower chair includes a platform front and back edges. A plurality of legs downwardly depend from the platform. A seat is rotatably mounted to the platform. The seat has a generally U-shaped cutout defining a spaced apart pair of forward extents and a rear portion connecting the forward extents of the seat together. A backrest is pivotally coupled to the seat. A pair of foot rests each have an elongate rod outwardly extending therefrom. The rod of a first of the foot rests is pivotally coupled to a first of the forwards extents. The rod of a second of the foot rests is pivotally coupled to a second of the forwards extents.

10 Claims, 2 Drawing Sheets

SHOWER CHAIR

BACKGROUND OF THE INVENTION

1. Field of the Invention

The present invention relates to bath and shower chairs and more particularly pertains to a new shower chair for permitting a user to take a shower without their legs becoming wet.

2. Description of the Prior Art

The use of bath and shower chairs is known in the prior art. More specifically, bath and shower chairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,335,377 by Masyada et al.; U.S. Pat. No. 3,290,090 by Ford; U.S. Pat. No. Des. 294,664 by Clark; U.S. Pat. No. 3,416,518 by Samuels et al.; U.S. Pat. No. 4,911,151 by Rankin et al.; and U.S. Pat. No. 4,987,249 by Mills.

While these devices fulfill their respective, particular objectives and requirements, the aforementioned patents do not disclose a new shower chair. The inventive device includes a platform front and back edges. A plurality of legs downwardly depend from the platform. A seat is rotatably mounted to the platform. The seat has a generally U-shaped cutout defining a spaced apart pair of forward extents and a rear portion connecting the forward extents of the seat together. A backrest is pivotally coupled to the seat. A pair of foot rests each have an elongate rod outwardly extending therefrom. The rod of a first of the foot rests is pivotally coupled to a first of the forwards extents. The rod of a second of the foot rests is pivotally coupled to a second of the forwards extents.

In these respects, the shower chair according to the present invention substantially departs from the conventional concepts and designs of the prior art, and in so doing provides an apparatus primarily developed for the purpose of permitting a user to take a shower without their legs becoming wet.

SUMMARY OF THE INVENTION

In view of the foregoing disadvantages inherent in the known types of bath and shower chairs now present in the prior art, the present invention provides a new shower chair construction wherein the same can be utilized for permitting a user to take a shower without their legs becoming wet.

The general purpose of the present invention, which will be described subsequently in greater detail, is to provide a new shower chair apparatus and method which has many of the advantages of the bath and shower chairs mentioned heretofore and many novel features that result in a new shower chair which is not anticipated, rendered obvious, suggested, or even implied by any of the prior art bath and shower chairs, either alone or in any combination thereof.

To attain this, the present invention generally comprises a platform front and back edges. A plurality of legs downwardly depend from the platform. A seat is rotatably mounted to the platform. The seat has a generally U-shaped cutout defining a spaced apart pair of forward extents and a rear portion connecting the forward extents of the seat together. A backrest is pivotally coupled to the seat. A pair of foot rests each have an elongate rod outwardly extending therefrom. The rod of a first of the foot rests is pivotally coupled to a first of the forwards extents. The rod of a second of the foot rests is pivotally coupled to a second of the forwards extents.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower chair apparatus and method which has many of the advantages of the bath and shower chairs mentioned heretofore and many novel features that result in a new shower chair which is not anticipated, rendered obvious, suggested, or even implied by any of the prior art bath and shower chairs, either alone or in any combination thereof.

It is another object of the present invention to provide a new shower chair which may be easily and efficiently manufactured and marketed.

It is a further object of the present invention to provide a new shower chair which is of a durable and reliable construction.

An even further object of the present invention is to provide a new shower chair which is susceptible of a low cost of manufacture with regard to both materials and labor, and which accordingly is then susceptible of low prices of sale to the consuming public, thereby making such shower chair economically available to the buying public.

Still yet another object of the present invention is to provide a new shower chair which provides in the apparatuses and methods of the prior art some of the advantages thereof, while simultaneously overcoming some of the disadvantages normally associated therewith.

Still another object of the present invention is to provide a new shower chair for permitting a user to take a shower without their legs becoming wet.

Yet another object of the present invention is to provide a new shower chair which includes a platform front and back edges. A plurality of legs downwardly depend from the platform. A seat is rotatably mounted to the platform. The seat has a generally U-shaped cutout defining a spaced apart pair of forward extents and a rear portion connecting the forward extents of the seat together. A backrest is pivotally coupled to the seat. A pair of foot rests each have an elongate rod outwardly extending therefrom. The rod of a first of the foot rests is pivotally coupled to a first of the forwards extents. The rod of a second of the foot rests is pivotally coupled to a second of the forwards extents.

Still yet another object of the present invention is to provide a new shower chair that provides a means for users with casts, splints and bandages on their legs to take a shower without their cast, splint or bandages from becoming wet.

Even still another object of the present invention is to provide a new shower chair that may be easily removed from a shower structure such as a bathtub or a shower stall so that other users may take a shower unhindered by the shower chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
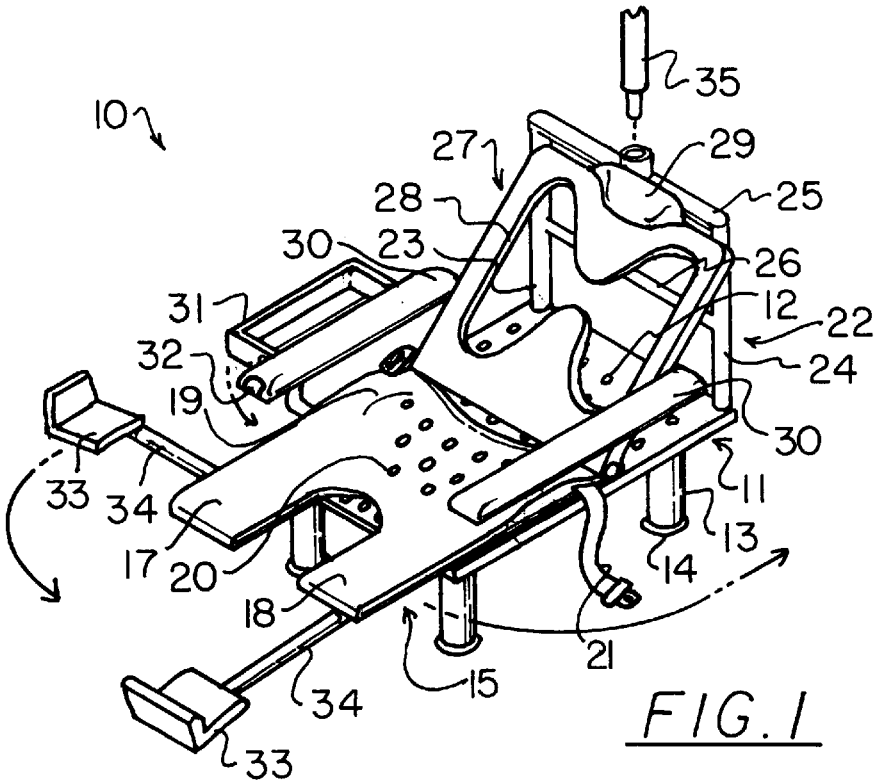
FIG. 1 is a schematic perspective view of a new shower chair according to the present invention.
Figure 2:
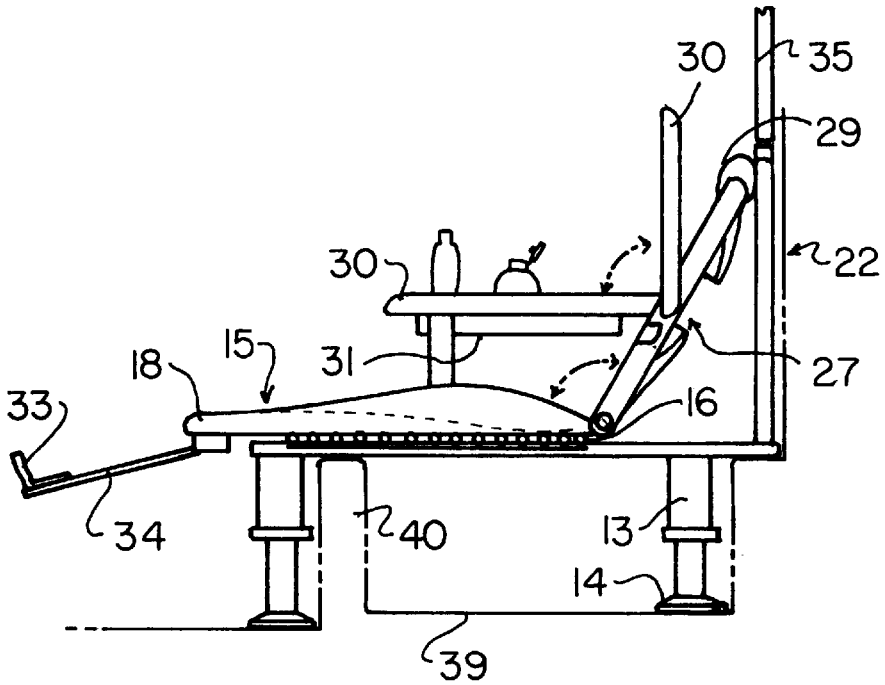
FIG. 2 is a schematic side view of the present invention.
Figure 3:
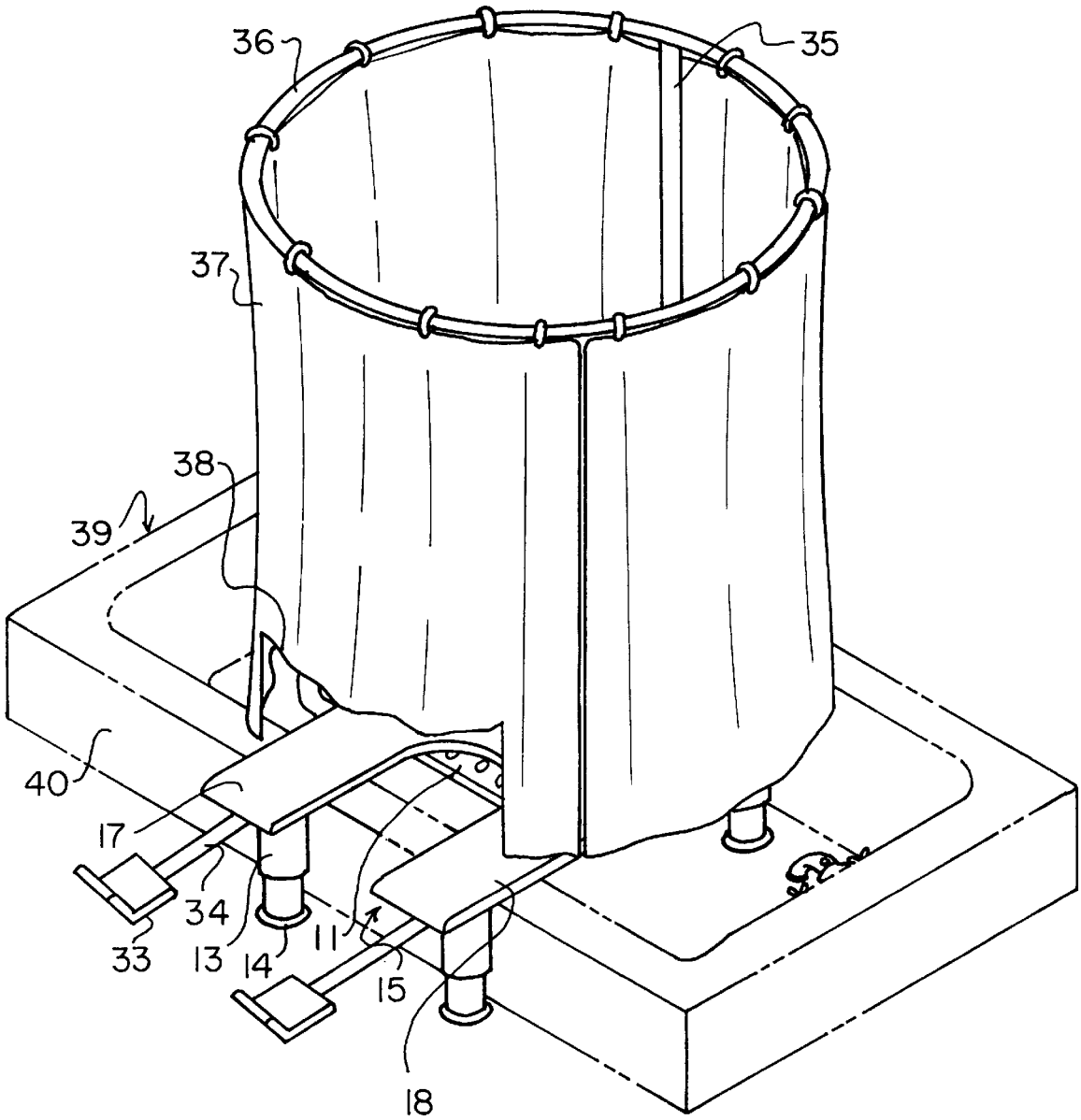
FIG. 3 is a schematic perspective view of the present invention in use in a bathtub.

With reference now to the drawings, and in particular to FIGS. 1 through 3 thereof, a new shower chair embodying the principles and concepts of the present invention and generally designated by the reference numeral 10 will be described.

As best illustrated in FIGS. 1 through 3, the shower chair 10 generally comprises a platform front and back edges. A plurality of legs downwardly depend from the platform. A seat is rotatably mounted to the platform. The seat has a generally U-shaped cutout defining a spaced apart pair of forward extents and a rear portion connecting the forward extents of the seat together. A backrest is pivotally coupled to the seat. A pair of foot rests each have an elongate rod outwardly extending therefrom. The rod of a first of the foot rests is pivotally coupled to a first of the forwards extents. The rod of a second of the foot rests is pivotally coupled to a second of the forwards extents.

In closer detail, the shower stall 10 comprises a generally rectangular platform 11 having substantially planar upper and lower surfaces, substantially straight and substantially parallel front and back edges, a pair of substantially straight and substantially parallel side edges extending between the front and back edges of the platform substantially perpendicular to the front and back edges of the platform, and a plurality of corners. The platform preferably has a plurality of spaced apart drain apertures 12 extending therethrough between the upper and lower faces of the platform. Ideally, the drain apertures of the platform is arranged in a grid-like fashion has a plurality of rows substantially parallel to the front and back edges of the platform and a plurality of columns substantially parallel to the side edges of the platform.

A plurality of legs 13 downwardly depend from the lower face of the platform. Preferably, each of the corners of the platform has one of the legs positioned there adjacent. In the preferred embodiment, the legs each are telescopically adjustably extendable to permit selective adjustment of the height of the legs. Each of the legs terminates at a foot 14 opposite the platform designed for resting on a resting surface. The feet of the legs each comprise a resiliently deformable rubber material for frictionally enhancing contact between the feet and the resting surface so that the legs to not easily slip on the resting surface. Optionally, the feet may comprise suction cups.

A seat 15 is provided with upper and lower faces. The lower face of the seat is rotatably mounted to the upper face of the platform by a swivel mount or bearing 16 to permit rotation of the seat with respect to the platform about an generally horizontal axis extending substantially perpendicular to the upper face of the platform. The seat has a generally U-shaped cutout defining a spaced apart pair of generally rectangular forward extents 17,18 and a rear portion 19 connecting the forward extents of the seat together. Preferably, the rear portion of the seat has a plurality of spaced apart drain apertures 20 extending therethrough between the upper and lower faces of the seat. As best illustrated in FIG. 2, the upper face of the seat preferably has an arcuate region in the rear portion of the seat. The arcuate region of the upper face of the seat has an upwardly facing convexity defined in a plane generally parallel to sides of the seat extending between the front and back of the seat.

The forwards extents of the seat are outwardly extended beyond from a periphery defined by the edges of the platform. In use, the forward extents is designed for supporting thereon the thighs of a user sitting on the seat. Ideally, the upper face of the seat comprising a resiliently deformable foamed material for comfort of a user sitting thereon. In an ideal embodiment, the seat also preferably has a seatbelt 21 for holding a user on the seat.

A back stop 22 upwardly extends from the upper face of the platform adjacent the back edge of the platform. The back stop preferably comprises a spaced apart pair of upwardly extending side posts 23,24 and spaced apart substantially parallel upper and lower cross bars 25,26 extending between the side posts of the back stop.

A backrest 27 is pivotally coupled to the rear of the seat. Preferably, the backrest has a generally bow-tie shaped cutout 28 therethrough comprising a pair of lobe regions and a constricted region connecting the lobe regions of the cutout of the backrest together. A headrest 29 is preferably coupled to an upper edge of the backrest. As illustrated in FIG. 2, when the seat is properly positioned, the headrest is rested on a cross bar of the back stop.

A pair of armrests 30 are pivotally coupled to the backrest to permit pivoting of the armrests about a generally horizontal axis. Preferably, a tray 31 is pivotally coupled to one of the armrests to permit pivoting of the tray about a generally horizontal axis extending generally parallel to the associated armrest. Ideally, a latch is provided for releasably holding the tray in an upright position with respect to the armrest. The latch has an actuator 32 on the armrest to permit a user to release the latch to let the tray pivot downwards.

A pair of foot rests 33 are provided each having an elongate rod 34 outwardly extending therefrom. The rod of a first of the foot rests is pivotally coupled to the lower face of the seat at a first of the forwards extents. Similarly, the rod of a second of the foot rests is pivotally coupled to the lower face of the seat at a second of the forwards extents. In use, the rods are pivotable about an generally vertical axis.

An elongate mast 35 is upwardly extended generally vertically from the back stop. As illustrated in FIG. 1, the mast is detachably attached to the upper cross bar of the back stop. An annular curtain rod 36 is coupled to an upper end of the mast so that the curtain rod is positioned about the platform. A curtain 37 is hung from the curtain rod to form a generally cylindrical enclosure. In use, the curtain is designed for preventing water from a shower head in the enclosure from spraying water out of the enclosure. As illustrated in FIG. 3, the forwards extents are outwardly extended from the enclosure through a lower cutout 38 in the curtain adjacent the forward extents to permit a user's legs to extend out of the enclosure.

In use, the shower chair is designed for use in a shower structure such as a bathtub or a shower stall. FIGS. 2 and 3 illustrate the shower chair in use in a bathtub 39 having a side wall 40. As illustrated in these Figures, a rear pair of the legs is positioned in the bathtub and a forwards pair of the legs is positioned outside the bathtub so that the forward extents and a portion of the platform extend over the side wall of the bathtub.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shower chair, comprising:

a platform front and back edges;

a plurality of legs downwardly depending from said platform;

a seat being rotatably mounted to said platform;

said seat having a generally U-shaped cutout defining a spaced apart pair of forward extents and a rear portion connecting said forward extents of said seat together;

a backrest being pivotally coupled to said seat; and a pair of foot rests each having an elongate rod outwardly extending therefrom, said rod of a first of said foot rests being pivotally coupled to a first of said forwards extents, said rod of a second of said foot rests being pivotally coupled to a second of said forwards extents.

2. The shower chair of claim 1, wherein said platform has a plurality of spaced apart drain apertures therethrough.

3. The shower chair of claim 2, wherein said drain apertures of said platform are arranged in a grid-like fashion having a plurality of rows substantially parallel to said front and back edges of said platform and a plurality of columns substantially perpendicular to said front and back edges of said platform.

4. The shower chair of claim 1, wherein said legs each are telescopically extendable.

5. The shower chair of claim 1, wherein each of said legs terminates at a foot opposite said platform, said feet of said legs each comprising a resiliently deformable material.

6. The shower chair of claim 1, further comprising a back stop upwardly extending from said upper face of said platform adjacent said back edge of said platform.

7. The shower chair of claim 6, further comprising an elongate mast upwardly extending from said back stop, an annular curtain rod being coupled to an upper end of said mast, said curtain rod being positioned about said platform, a curtain being hung from said curtain rod, said curtain forming an enclosure around said platform, said forwards extents being outwardly extended from said enclosure.

8. The shower curtain of claim 7, wherein said curtain has a lower cutout adjacent said forward extents.

9. The shower curtain of claim 1, wherein said backrest has a generally bow-tie shaped cutout therethrough comprising a pair of lobe regions and a constricted region connecting said lobe regions of said cutout of said backrest together.

10. A shower chair, comprising:

a generally rectangular platform having substantially planar upper and lower surfaces, substantially straight and substantially parallel front and back edges, a pair of substantially straight and substantially parallel side edges extending between said front and back edges of said platform substantially perpendicular to said front and back edges of said platform, and a plurality of corners;

said platform having a plurality of spaced apart drain apertures extending therethrough between said upper and lower faces of said platform;

said drain apertures of said platform being arranged in a grid-like fashion having a plurality of rows substantially parallel to said front and back edges of said platform and a plurality of columns substantially parallel to said side edges of said platform;

a plurality of legs downwardly depending from said lower face of said platform, each of said corners of said platform having one of said legs positioned there adjacent;

said legs each being telescopically extendable;

each of said legs terminating at a foot opposite said platform, said feet of said legs each comprising a resiliently deformable material;

a seat having upper and lower faces, said lower face of said seat being rotatably mounted to said upper face of said platform to permit rotation of said seat with respect to said platform about an axis extending substantially perpendicular to said upper face of said platform;

said seat having a generally U-shaped cutout defining a spaced apart pair of generally rectangular forward extents and a rear portion connecting said forward extents of said seat together;

said rear portion of said seat having a plurality of spaced apart drain apertures extending therethrough between said upper and lower faces of said seat;

said upper face of said seat having an arcuate region in said rear portion of said seat, said arcuate region of said upper face of said seat having an upwardly facing convexity;

said forwards extents of said seat being outwardly extended from a periphery defined by said edges of said platform;

said upper face of said seat comprising a resiliently deformable foamed material;

a back stop upwardly extending from said upper face of said platform adjacent said back edge of said platform, said back stop comprising a spaced apart pair of upwardly extending side posts and spaced apart substantially parallel upper and lower cross bars extending between said side posts of said back stop;

a backrest being pivotally coupled to said rear of said seat, said backrest having a generally bow-tie shaped cutout therethrough comprising a pair of lobe regions and a constricted region connecting said lobe regions of said cutout of said backrest together;

a headrest being coupled to an upper edge of said backrest, said headrest being rested on a cross bar of said back stop;

a pair of armrests being pivotally coupled to said backrest;

a tray being pivotally coupled to one of said armrests;

a pair of foot rests each having an elongate rod outwardly extending therefrom, said rod of a first of said foot rests being pivotally coupled to said lower face of said seat at a first of said forwards extents, said rod of a second of said foot rests being pivotally coupled to said lower face of said seat at a second of said forwards extents;

an elongate mast being upwardly extended generally vertically from said back stop, said mast being detachably attached to said upper cross bar of said back stop;

an annular curtain rod being coupled to an upper end of said mast, said curtain rod being positioned about said platform;

a curtain being hung from said curtain rod, said curtain forming a generally cylindrical enclosure; and said forwards extents being outwardly extended from said enclosure, said curtain having a lower cutout adjacent said forward extents.

* * * * *